US009704668B2

(12) United States Patent
Osako et al.

(10) Patent No.: US 9,704,668 B2
(45) Date of Patent: Jul. 11, 2017

(54) INPUT DEVICE

(71) Applicant: ALPS ELECTRIC CO., LTD., Tokyo (JP)

(72) Inventors: Hajime Osako, Miyagi-ken (JP); Ryuichi Watanabe, Miyagi-ken (JP); Yoshiyuki Tagawa, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/074,748

(22) Filed: Mar. 18, 2016

(65) Prior Publication Data

US 2016/0293361 A1 Oct. 6, 2016

(30) Foreign Application Priority Data

Apr. 1, 2015 (JP) ..... 2015-075232

(51) Int. Cl.

*H01H 13/06* (2006.01)
*H01H 13/52* (2006.01)
*H01H 13/48* (2006.01)

(52) U.S. Cl.

CPC ..... *H01H 13/52* (2013.01); *H01H 13/06* (2013.01); *H01H 13/48* (2013.01); *H01H 2215/004* (2013.01); *H01H 2215/028* (2013.01); *H01H 2217/016* (2013.01); *H01H 2221/05* (2013.01); *H01H 2223/002* (2013.01); *H01H 2223/003* (2013.01)

(58) Field of Classification Search

CPC .... H01H 25/041; H01H 25/008; H01H 23/14; H01H 2221/044; H01H 13/14; H01H 13/48

USPC ..... 200/513, 511, 341

See application file for complete search history.

(56) References Cited

U.S. PATENT DOCUMENTS 6,246,019 B1 * 6/2001 Nakamura ..... H01H 13/702 200/5 R

FOREIGN PATENT DOCUMENTS

| | | |
|---|---|---|
| EP | 1 310 969 A1 | 5/2003 |
| JP | 2003-151407 | 5/2003 |

* cited by examiner

*Primary Examiner* — Edwin A. Leon
*Assistant Examiner* — Ahmed Saeed
(74) *Attorney, Agent, or Firm* — Brinks Gilson & Lione

(57) ABSTRACT

An input device includes: a switch unit that has a fixed contact and a movable contact placed so as to be movable away from and toward the fixed contact; a rubber member provided so as to be elastically deformable, the rubber member pressing the movable contact; and a slide member placed so as to be movable so that the slide member can press the rubber member. The rubber member has a first load generating part, which presses the movable contact, and a plurality of load adjusting parts disposed so as to enclose the first load generating part. The slide member has a first pressing part, which presses the first load generating part, and a plurality of second pressing parts, which press the plurality of load adjusting parts.

5 Claims, 10 Drawing Sheets

INPUT DEVICE

CLAIM OF PRIORITY

This application claims benefit of priority to Japanese Patent Application No. 2015-075232 filed on Apr. 1, 2015, which is hereby incorporated by reference in its entirety.

BACKGROUND

1. Field of the Disclosure

The present disclosure relates to an input device that turns on a switching unit in response to a pressing load applied by an input manipulation.

2. Description of the Related Art

When a reliable manipulation is required for an input device that turns on a switching unit in response to a pressing load applied by an input manipulation, a setting to turn on the switching unit with a higher load is demanded. To meet this demand, measures have been devised.

Japanese Unexamined Patent Application Publication No. 2003-151407, for example, discloses a mechanism that uses dome-shaped elastic pressure members to generate a pressing load.

FIG. 9 is a cross-sectional view of a mirror switch device 100 described in Japanese Unexamined Patent Application Publication No. 2003-151407. FIG. 10 is a plan view of a pressure member unit 124 used in the mirror switch device 100.

A circuit board 115 is disposed in a switch case 114 and the pressure member unit 124, which includes eight elastic pressure members 116 to 123, is provided on the circuit board 115, as illustrated in FIGS. 9 and 10. These elastic pressure members 116 to 123, which are made of a rubber, are shaped like a dome. Each elastic pressure member 123 illustrated in FIG. 9 has a manipulated part 123*b* at the top of a thin rising part 123*a*. A switching unit 132 has a movable contact plate 132*a*, which is formed on the rear surface of the manipulated part 123*b* of the elastic pressure member 123, and a fixed contact 132*b*, which is formed on the circuit board 115 so as to face the movable contact plate 132*a*, as illustrated in FIG. 9. A pusher 126, which is pressed by a manipulation knob 125, is provided on the same side as the manipulated parts 116*b* to 123*b* of the elastic pressure members 116 to 123.

The manipulated part 123*b*, for example, receives a pressing force exerted in the direction indicated by the arrow A in FIG. 9 and moves in that direction while the rising part 123*a* is deformed. When the pressing force is eliminated, the manipulated part 123*b* returns to its original position due to the elastic restoring force of the rising part 123*a*.

A load needed to deform the rising parts 116*a* to 123*a* of the elastic pressure members 116 to 123 can be set by selecting a rubber material and changing the thickness, the height, and other parameters of the shapes of the rising parts 116*a* to 123*a*. Therefore, it is possible to set a pressing load applied to the input device by making an adjustment so that the elastic pressure members 116 to 123 are deformed with a load higher than a contact load under which the movable contact plate 132*a* and fixed contact 132*b*, for example, are electrically connected.

SUMMARY

An input device includes: a switch unit that has a fixed contact and a movable contact placed so as to be movable away from and toward the fixed contact; a rubber member provided so as to be elastically deformable, the rubber member pressing the movable contact; and a slide member placed so as to be movable so that the slide member can press the rubber member. The rubber member has a first load generating part, which presses the movable contact, and a plurality of load adjusting parts disposed so as to enclose the first load generating part. The slide member has a first pressing part, which presses the first load generating part, and a plurality of second pressing parts, which press the plurality of load adjusting parts.

In this structure, a total load can be determined from the sum of a load generated by the plurality of load adjusting parts disposed on the rubber member and a load generated by the first load generating part disposed on the rubber member, the first load generating part pressing the movable contact. Therefore, freedom can be increased in adjustment of the amount of elastic deformation and the pressing load, enabling finer settings to be made for the stroke and pressing load.

BRIEF DESCRIPTION OF THE DRAWINGS

FIG. 7 is a cross-sectional view illustrating the same cross-section as in FIG. 5, indicating a state in which the slide member has been pressed and a switch unit is turned on;

DESCRIPTION OF THE EXEMPLARY EMBODIMENTS

First Embodiment

Figure 1:
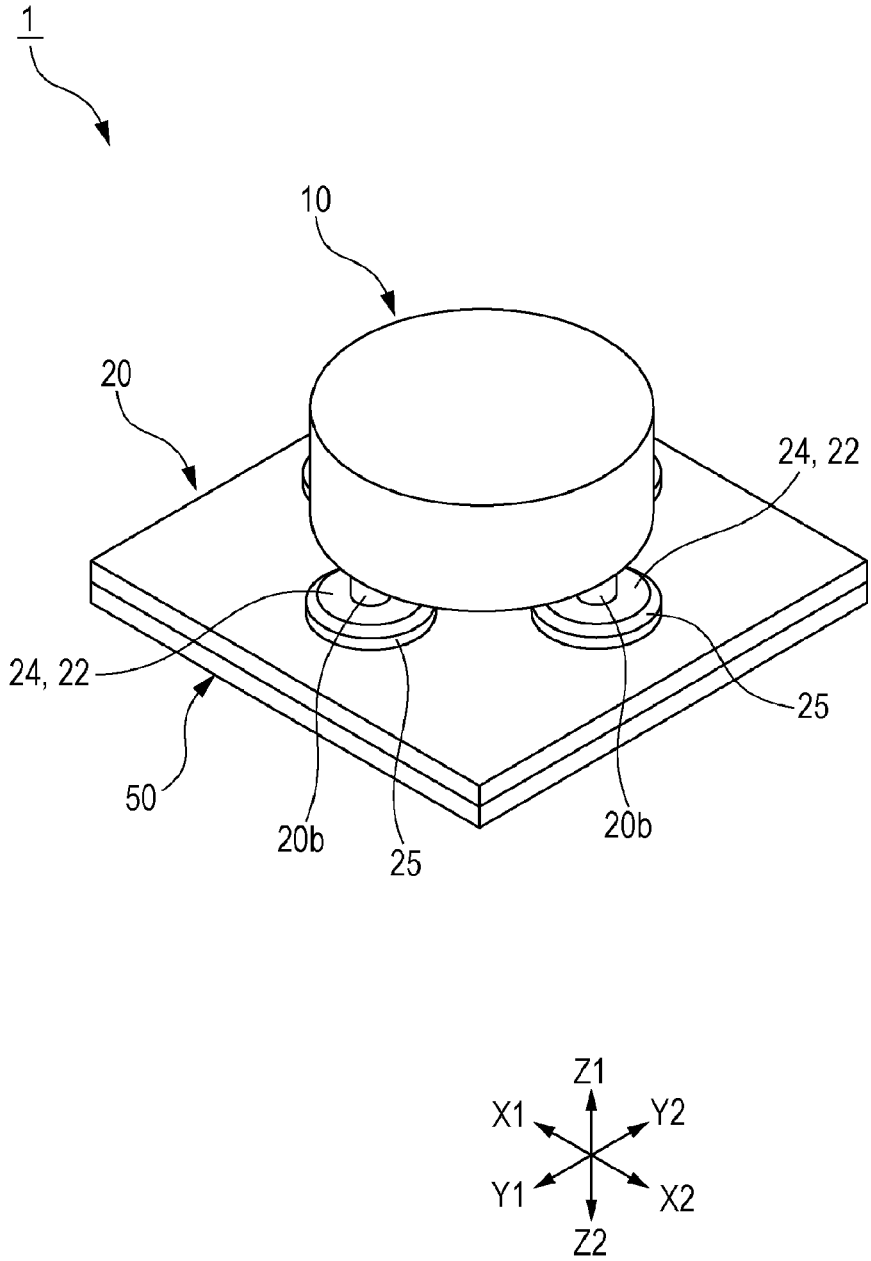
FIG. 1 is a perspective view of an input device in an embodiment of the present invention.

An embodiment of the present invention will be described below in detail with reference to the drawings. For easy understanding, dimensions in the drawings have been appropriately changed.

Figure 2:
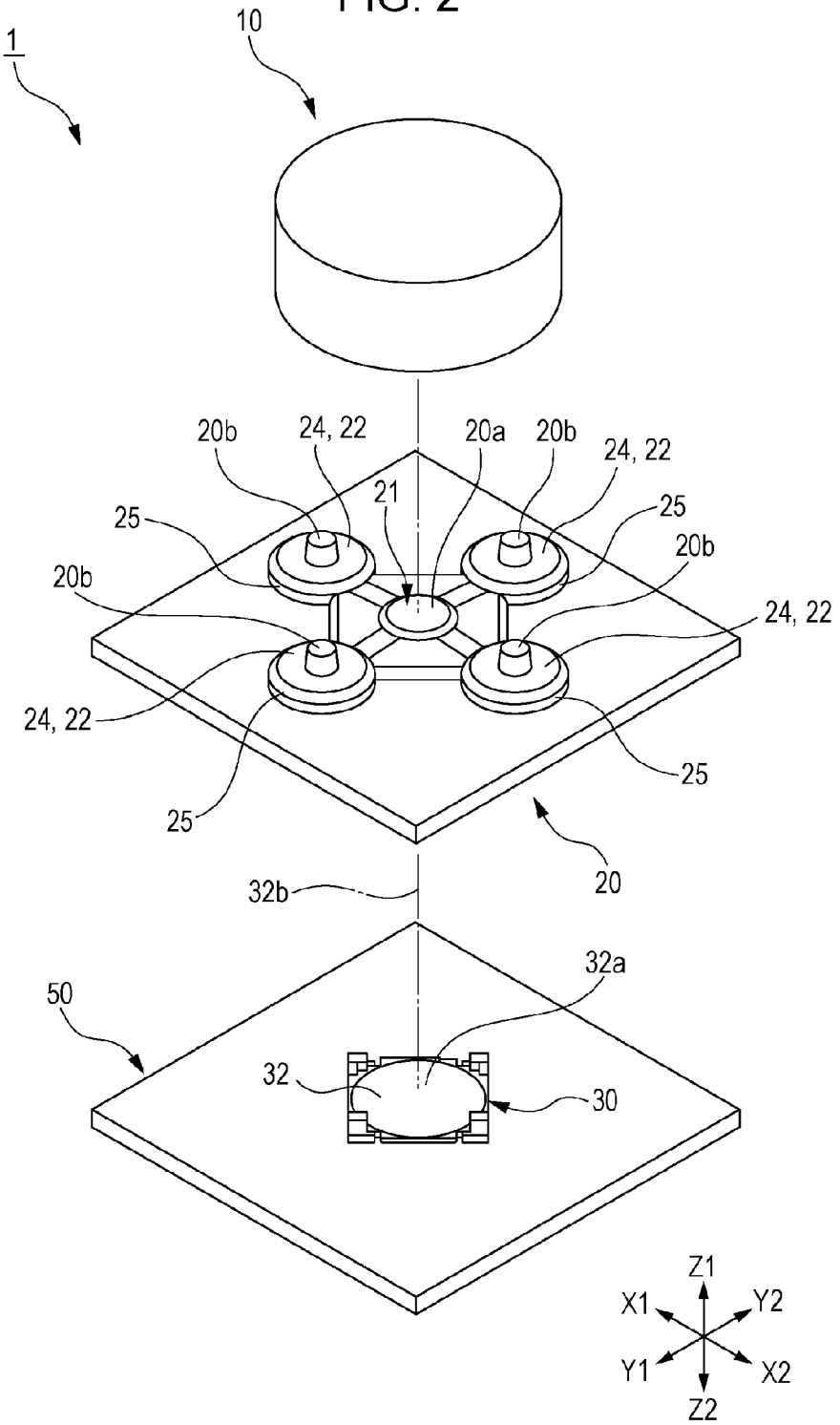
FIG. 2 is an exploded perspective view of the input device in the embodiment of the present invention, as viewed from above at an oblique angle.
Figure 3:
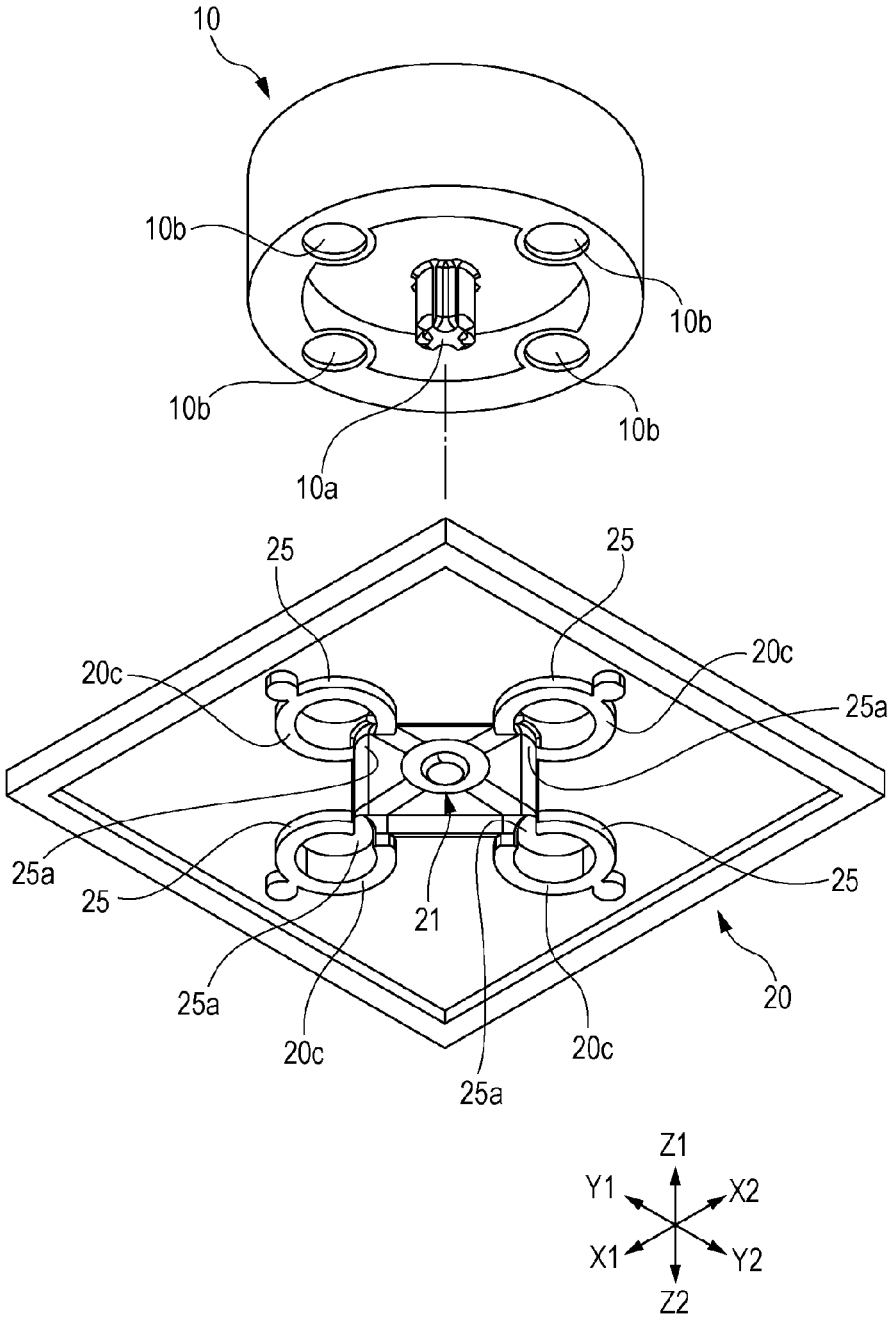
FIG. 3 is an exploded perspective view of the slider member and rubber member in FIG. 2, as viewed from below at an oblique angle.
Figure 4:
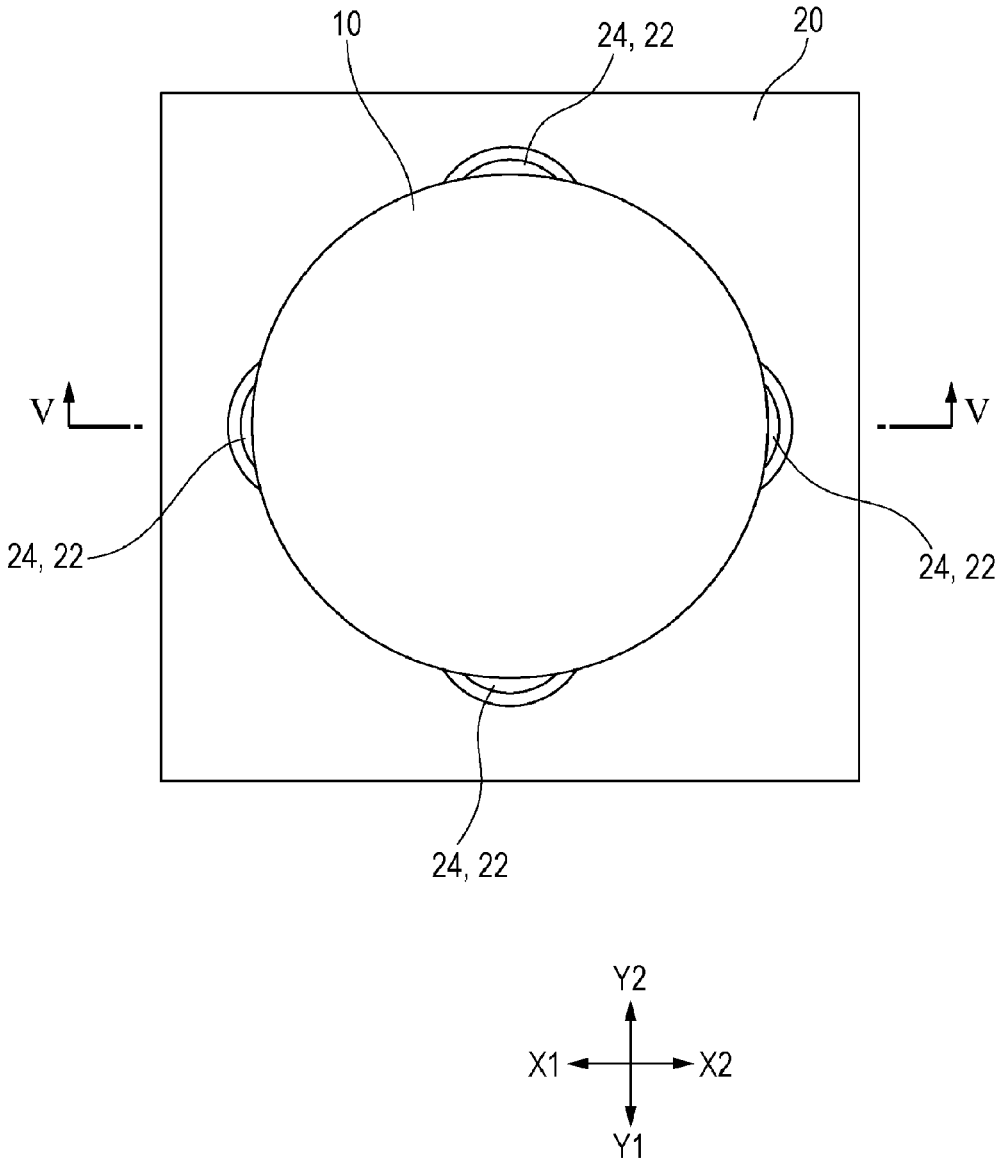
FIG. 4 is a plan view of the input device in the embodiment of the present invention.
Figure 5:
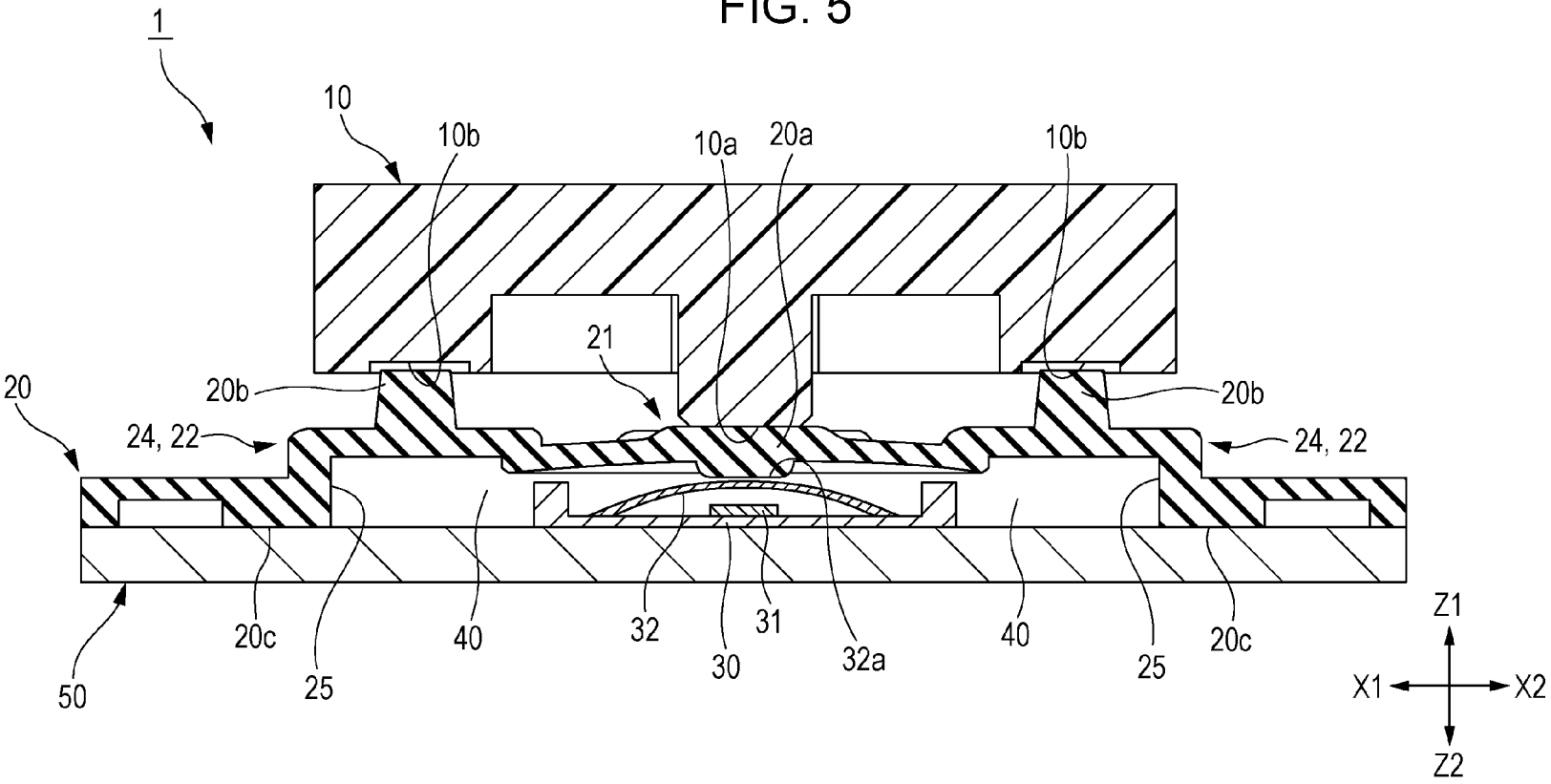
FIG. 5 is a cross-sectional view taken along line V-V in FIG. 4.
Figure 6:
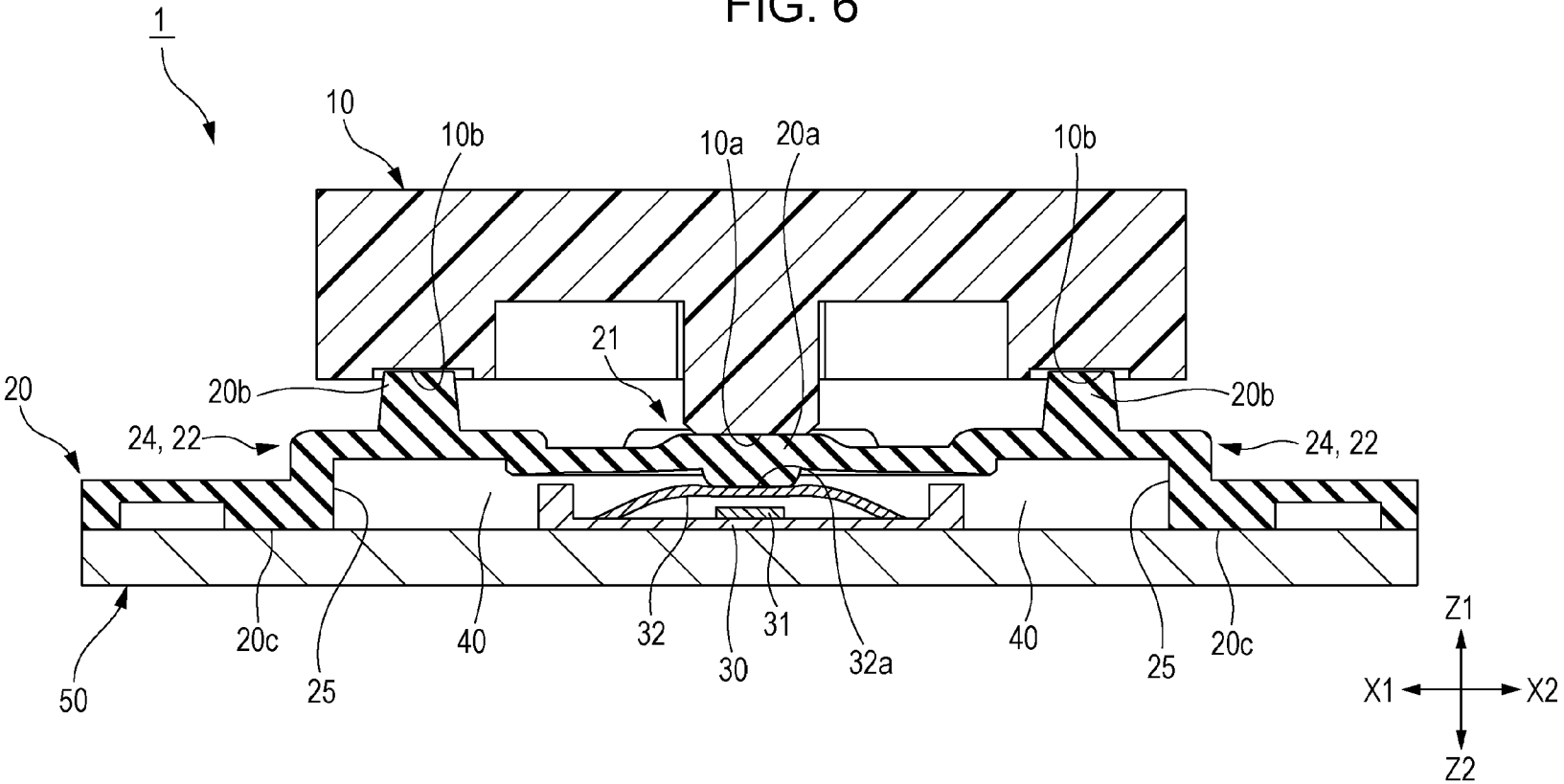
FIG. 6 is a cross-sectional view illustrating the same cross-section as in FIG. 5, indicating a state in the middle of pressing the slide member.
Figure 7:
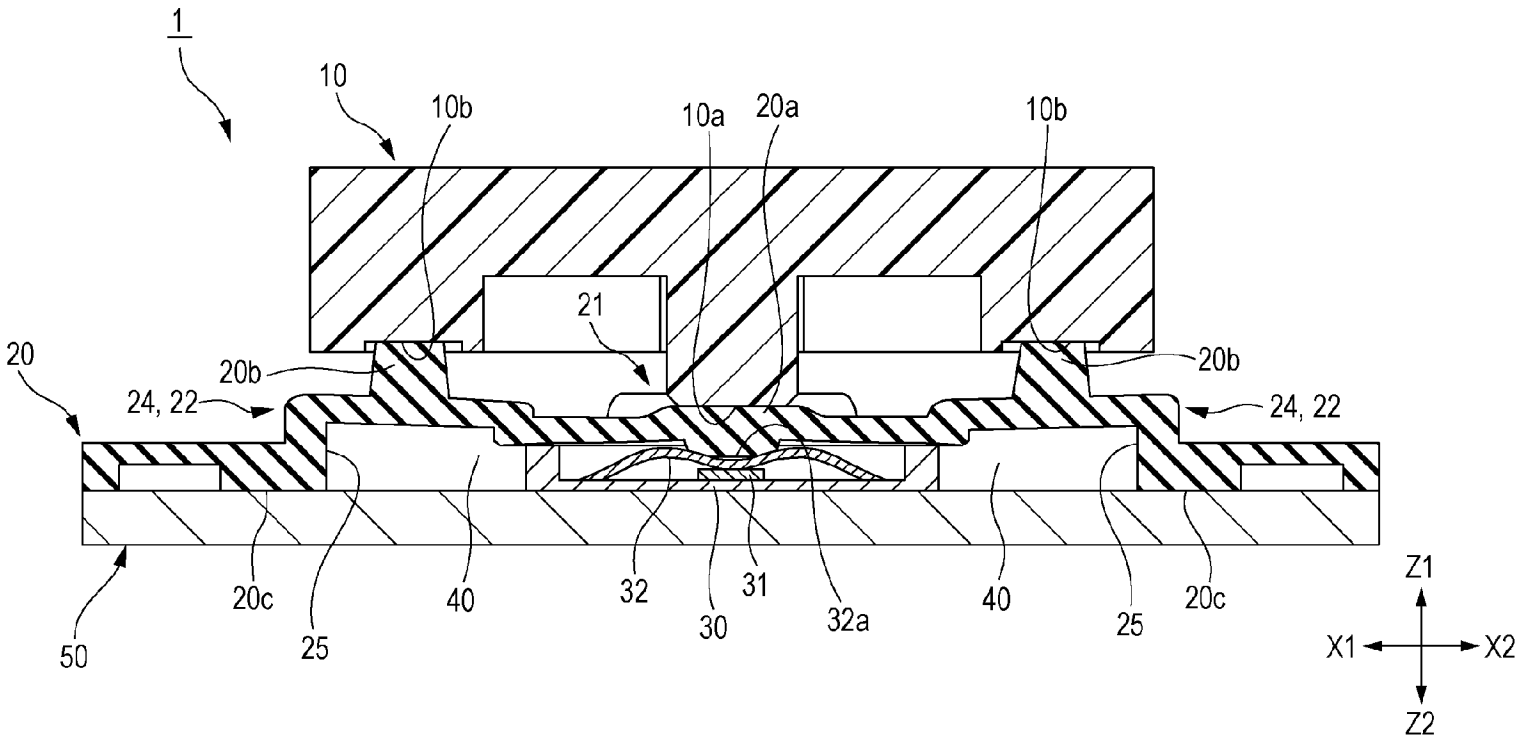
Figure 8:
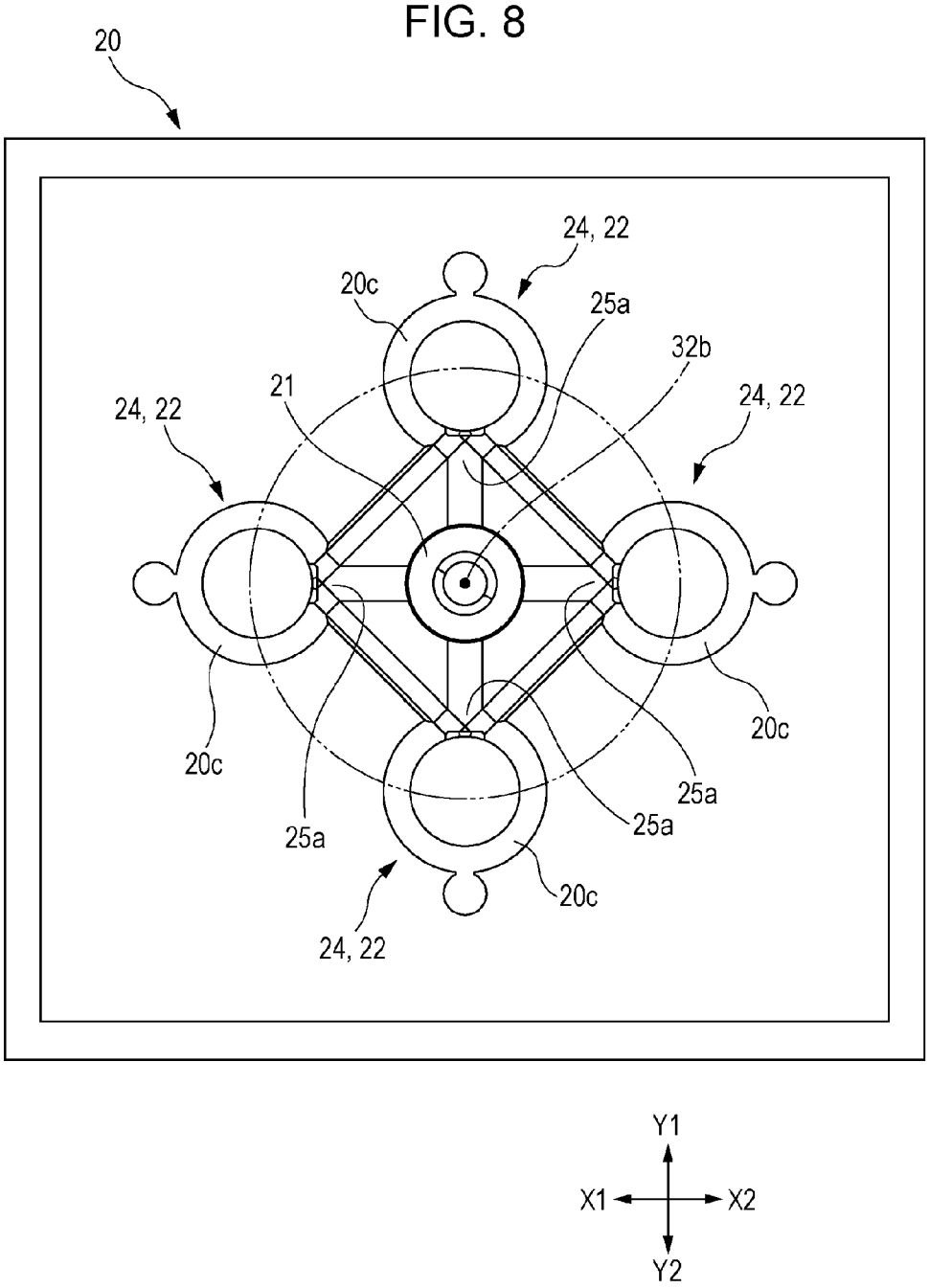
FIG. 8 is a bottom view of the rubber member.
Figure 9:
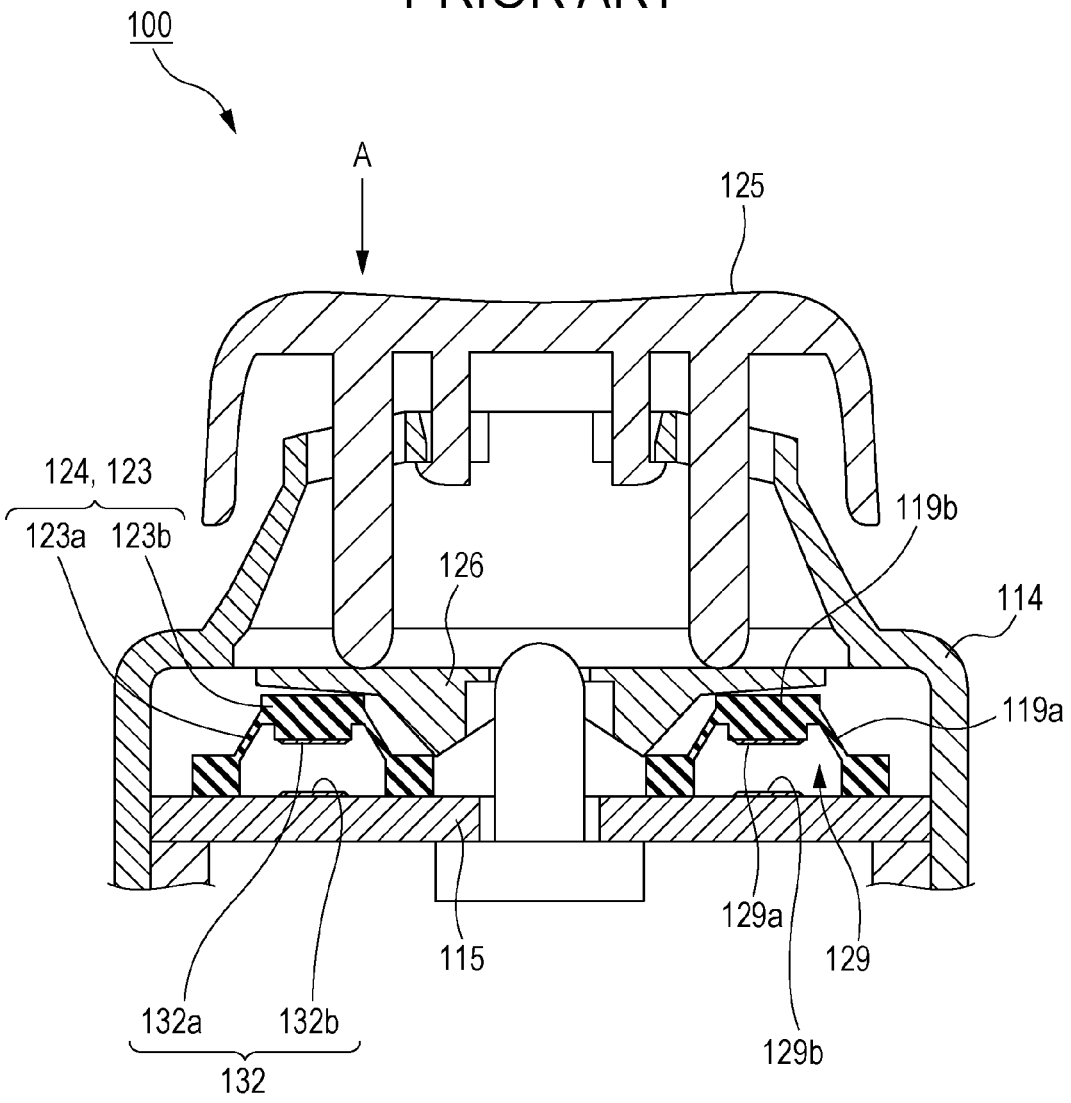
FIG. 9 PRIOR ART
FIG. 9 is a cross-sectional view of a conventional mirror switch device.
Figure 10:
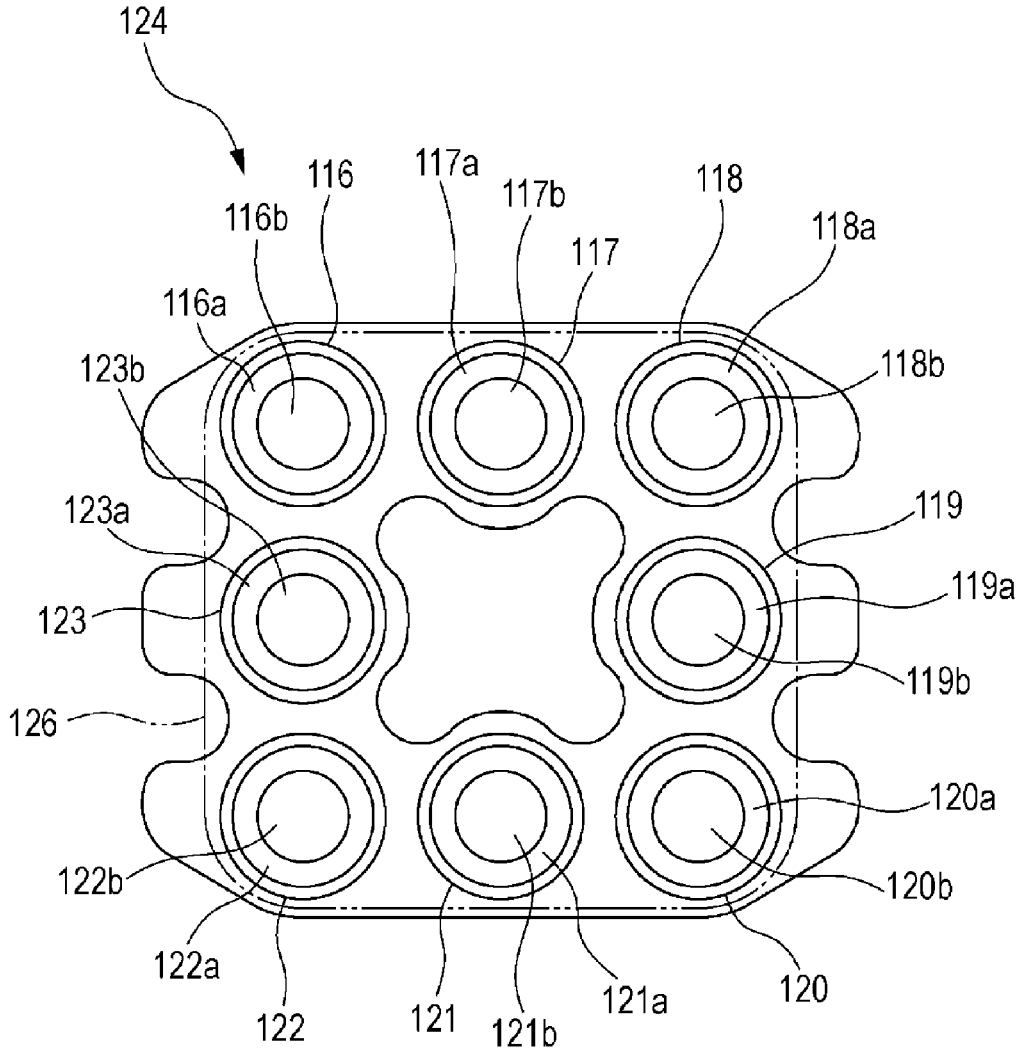
FIG. 10 PRIOR ART
FIG. 10 is a plan view of a pressure member unit used in the conventional mirror switch device.

FIG. 1 is a perspective view of an input device 1 in an embodiment of the present invention. In the descriptions below, the Z1 direction and Z2 direction in FIG. 1 will be respectively taken as the upward direction and the downward direction. FIG. 2 is an exploded perspective view of the input device 1, as viewed from above at an oblique angle. FIG. 3 is an exploded perspective view of a slider member 10 and a rubber member 20 in FIG. 2, as viewed from below at an oblique angle. FIG. 4 is a plan view of the input device 1. FIG. 5 is a cross-sectional view taken along line V-V in FIG. 4. FIG. 6 is a cross-sectional view illustrating the same cross-section as in FIG. 5, indicating a state in the middle of pressing the slide member 10. FIG. 7 is a cross-sectional view illustrating the same cross-section as in FIG. 5, indicating a state in which the slide member 10 has been pressed and a switch unit 30 is turned on. FIG. 8 is a bottom view of the rubber member 20.

The input device 1, in this embodiment, is turned on by a pressing load applied in an input manipulation. The input device 1 provides a manipulation feeling in which a change in a load is felt. The input device 1 is suitable when a reliable manipulation is demanded; the input device responds to this demand by being set so that the input device 1 is turned on under a high load.

The input device 1 in this embodiment includes the slide member 10, rubber member 20, and switch unit 30 as illustrated in FIGS. 1 to 5. In this description, the structure of a device to which the input device 1 is connected and electrical connections are not covered, nor are they illustrated in FIG. 1.

The slide member 10 is shaped so that it can freely fit to a through-hole formed in a case (not illustrated). The slide member 10 is moved in response to an input manipulation by the manipulator. The slide member 10 is not limited to a structure in which the manipulator presses the slide member 10 to move it; the slide member 10 may be moved by performing an input manipulation on another manipulated member. With the input device 1 in this embodiment, the slide member 10 is made of a synthetic resin and has a pressing part 10*a* and a plurality of pressing parts 10*b* on the same side as the Z2 axis, as illustrated in FIGS. 3 and 5.

The switch unit 30 is placed on a supporting circuit board 50 and is connected to wires (not illustrated). As illustrated in FIG. 5, the switch unit 30 has a fixed contact 31 made of a conductive metal and a movable contact 32 placed so as to be movable away from and toward the fixed contact 31. The movable contact 32 is a conductive metal plate having an invertible dome shape at a top 32*a*. The movable contact 32 is structured so that when its vertex is pressed toward the fixed contact 31, the shape of the top 32*a* is inverted and the movable contact 32 comes into contact with the fixed contact 31. When the pressing force is removed, the movable contact 32 returns to its original position, separating from the fixed contact 31. When the shape of the top 32*a* is inverted, the manipulator can obtain a manipulation feeling in which a load is changed.

The rubber member 20 is preferably made of a material that is elastic such as a silicon rubber and into which less water infiltrates, and is preferably shaped in a thin stereoscopic shape. As illustrated in FIGS. 1 to 5, the rubber member 20 is preferably formed in a sheet-like shape so as to cover the switch unit 30. The side on the rubber member 20 in a sheet-like shape on the same side as the Z1 direction will now be referred to as the front surface side, and the side on the same side as the Z2 direction will now be referred to as the rear surface side.

With the input device 1 in this embodiment, the rubber member 20 preferably has a pressed part 20*a* and a plurality of pressed parts 20*b*, which are pressed by the slide member 10, on the front surface side as illustrated in FIG. 2. The rubber member 20, the rear surface of which preferably faces a hollow 40, is provided so as to be elastically deformable in a state in which the rubber member 20 abuts the supporting circuit board 50 and is supported by it in such a way that the hollow 40 is formed around the switch unit 30, as illustrated in FIG. 5. The rear surface side of the pressed part 20*a* is shaped so that when it is pressed by the slide member 10, the rear surface side can press the top 32*a* of the movable contact 32.

Thus, the rubber member 20 has a first load generating part 21, which presses the movable contact 32, and a plurality of load adjusting parts 24 placed so as to enclose the first load generating part 21. The first load generating part 21 applies a manipulation load needed to press the switch unit 30 to the slide member 10 as a reactive force of the first load generating part 21. The first load generating part 21 is disposed in such a way that the pressing part 10*a* of the slide member 10 can abut the pressed part 20*a* of the rubber member 20. The load adjusting part 24 applies an additional manipulation force to the slide member 10. The load adjusting part 24 is disposed in such a way that the pressing part 10*b* of the slide member 10 can abut the relevant pressed part 20*b* of the rubber member 20. When the rubber member 20 is warped toward the hollow 40, the load adjusting part 24 can release an excessive load. Furthermore, a load can be increased or decreased by changing the thickness of the rubber member 20. Therefore, the additional manipulation load applied to the slide member 10 is adjustable to a desired load. In the initial state of the input device 1 in this embodiment, the pressing part 10*a* of the slide member 10 is in contact with the pressed part 20*a* and each pressing part 10*b* leaves a small clearance between it and its relevant pressed part 20*b*, as illustrated in FIG. 5.

Next, the operation of the input device 1 in this embodiment will be described with reference to FIGS. 5 to 7.

In the initial state illustrated in FIG. 5, the pressing part 10*a* of the slide member 10 is in contact with the pressed part 20*a* so that the first load generating part 21 presses the movable contact 32, as illustrated in FIG. 5. When a manipulation load is applied to the slide member 10, the rubber member 20 is elastically deformed at the first load generating part 21, pressing the top 32*a* of the movable contact 32 downwardly and increasing the manipulation load generated at the first load generating part 21. If, at this time, the pressing part 10*b* of the slide member 10 abuts the relevant pressed part 20*b* of the rubber member 20 at the load adjusting part 24 as illustrated in FIG. 6, a reactive force generated due to the elastic deformation at the load adjusting part 24 is added to the pressing manipulation performed on the slide member 10 as a manipulation load. If the slide member 10 is further pressed, the shape of the top 32*a* of the movable contact 32 is inverted and the switch unit 30 is turned on as illustrated in FIG. 7. The manipulation load generated at the load adjusting part 24 during a shift from the state in FIG. 6 to the state in FIG. 7 is a reactive force generated as a result of the rubber member 20 being elastically deformed. As an amount by which the pressed part 20*b* is pressed is increased, the reactive force tends to be monotonously increased. At the first load generating part 21, however, the manipulation load is reduced when the shape of the top 32*a* of the movable contact 32 is inverted. The amount of reduction in the manipulation load at the first load generating part 21 is greater than the amount of monotonous increase in the manipulation load at the load adjusting part 24. Therefore, the manipulator of the slide member 10 feels the manipulation feeling that the manipulation load that has been monotonously increased as the pressing manipulation has proceeded is suddenly reduced.

Next, it will be described in detail that a stroke and a pressing load can be finely set for the input device 1 in this embodiment.

With the input device 1 in this embodiment, the slide member 10 is made of a synthetic resin and a stroke in the movement of the slide member 10 is the amount of movement of the pressing part 10*a*. As illustrated in FIGS. 5 to 7, the amount of movement of the pressing part 10*a* is the sum of the amount of elastic deformation of the rubber member 20 and the amount of change due to the inversion of the shape of the movable contact 32. Therefore, to increase the stroke, it suffices for the rubber member 20 to be more easily elastically deformed by changing not only the shape of the movable contact 32 but also the material of the rubber member 20 and its thickness (dimension in the vertical dimension) at the first load generating part 21.

The lower limit of the pressing load is the reactive force generated at the first load generating part 21 during the movement of the pressing part 10*a* described above. To increase the pressing load without changing the stroke, it suffices to use the load adjusting part 24 to apply an additional manipulation load to the slide member 10. In this embodiment, the first load generating part 21 is preferably disposed so as to be rotationally symmetric with respect to the center line 32*b* of the switch unit 30, the center line 32*b* passing through the top 32*a* of the movable contact 32, as illustrated in FIG. 8. The load adjusting parts 24 are preferably second load generating parts 22 disposed at four places so as to be equally spaced on a circumference of a circle about the center line 32*b*.

On the rubber member 20, supported members 20*c* in contact with the supporting circuit board 50 are placed at the four places at which the second load generating parts 22 are placed so as to form the hollow 40. Each second load generating part 22, which is the load adjusting part 24, is preferably formed in a thin stereoscopic shape that has the supported members 20*c* and a side wall 25 in a cylindrical shape. As illustrated in FIG. 3, an opening 25*a* is preferably formed in part of the side wall 25, the opening 25*a* being open toward the first load generating part 21. Accordingly, at each second load generating part 22, the pressed part 20*b* is elastically deformable in the vertical direction, but is less likely to be pressed at an oblique angle. Since the side wall 25 in a cylindrical shape suppresses the rubber member 20 from being warped, freedom is increased in adjustment of the pressing load, enabling finer settings to be made. Since part of the side wall 25 is open toward the first load generating part 21, even if the height of the pressed part 20*b* and the thickness of the rubber member 20 are changed, the first load generating part 21 is less affected, enabling the manipulation load at the second load generating part 22 to be easily adjusted.

Since the second load generating parts 22 are placed on a circumference of a circle as the load adjusting parts 24, they are well balanced. The attitude of the slide member 10 at the time of pressing is stabilized. The manipulation load added by the second load generating part 22 can be set by setting the material of the rubber member 20 and various dimensions of the second load generating part 22. The manipulation load is adjustable by changing, for example, the height and diameter of the columnar portion of the pressed part 20*b*, the thickness of the rubber member 20 at a portion facing the hollow 40, and the dimensions (inner diameter, outer diameter, and height) of the side wall 25. In addition, a timing at which the pressed part 20*a* disposed at the first load generating part 21 abuts the pressing part 10*a* is preferably set so as to differ from timings at which the pressed parts 20*b* disposed at the load adjusting parts 24 abut the pressing parts 10*b*. Therefore, the load adjusting part 24 can apply a load at any timing depending on a clearance between the pressed part 20*b* and the pressing part 10*b* in the initial state.

With the input device 1 in this embodiment, the rubber member 20 covers the switch unit 30, so a water-proof structure can be easily formed.

Effects obtained in this embodiment will be described below.

The input device 1 in this embodiment includes: the switch unit 30 that has the fixed contact 31 and the movable contact 32 placed so as to be movable away from and toward the fixed contact 31; the rubber member 20 provided so as to be elastically deformable, the rubber member 20 pressing the movable contact 32; and the slide member 10 placed so as to be movable so that the slide member 10 can press the rubber member 20. The rubber member 20 has the first load generating part 21, which presses the movable contact 32, and a plurality of load adjusting parts 24 disposed so as to enclose the first load generating part 21. The slide member 10 has the pressing part 10*a*, which presses the first load generating part 21, and a plurality of pressing parts 10*b*, which press a plurality of load adjusting parts 24.

In this structure, a total load can be determined from the sum of a load generated by the plurality of load adjusting parts 24 disposed on the rubber member 20 and a load generated by the first load generating part 21 disposed on the rubber member 20, the first load generating part 21 pressing the movable contact 32. Therefore, freedom can be increased in adjustment of the amount of elastic deformation and the pressing load, enabling finer settings to be made for the stroke and pressing load.

With the input device 1 in this embodiment, each load adjusting part 24 is preferably the second load generating part 22, which is adjustable so as to generate a different load from the first load generating part 21. The first load generating part 21 is preferably disposed so as to be rotationally symmetric with respect to the center line 32*b* of the switch unit 30. The second load generating parts 22 are preferably disposed so as to be equally spaced on a circumference of a circle about the center line 32*b*.

Since, in this structure, the second load generating parts 22 are placed, as the load adjusting parts 24, so as to be equally spaced on a circumference of a circle, they are well balanced. The attitude of the slide member 10 at the time of pressing is stabilized.

With the input device 1 in this embodiment, the rubber member 20 preferably has the pressed part 20*a* and a plurality of pressed parts 20*b*, the pressed part 20*a* and pressed parts 20*b* being pressed by the slide member 10. A timing at which the pressed part 20*a*, which is disposed at the first load generating part 21, abuts the pressing part 10*a* is preferably set so as to differ from timings at which the pressed parts 20*b*, which are disposed at the load adjusting parts 24, abut the pressing parts 10*b*.

Since, in this structure, abutting timings vary, a load can be applied at any timing.

With the input device 1 in this embodiment, at the load adjusting part 24, the rubber member 20 is preferably formed in a thin stereoscopic shape, and the rear surface of the pressed part 20*b* preferably faces the hollow 40 at a portion that abuts the pressing part 10*b*.

In this structure, when the rubber member 20 is warped toward the hollow 40, an excessive load can be released, so adjustment to any load is possible by changing the thickness of the rubber member 20.

With the input device 1 in this embodiment, the load adjusting part 24 is preferably formed in a thin stereoscopic shape having the side wall 25 in a cylindrical shape and part of the side wall 25 is preferably open toward the first load generating part 21.

Since, in this structure, the side wall 25 in a cylindrical form suppresses the rubber member 20 from being warped, freedom is increased in adjustment of the pressing load, enabling finer settings to be made.

With the input device 1 in this embodiment, the rubber member 20 is made of a material into which less water infiltrates and is formed in a sheet-like shape so as to cover the switch unit 30.

Since, in this structure, the rubber member 20 covers the switch unit 30, a water-proof structure can be easily formed.

So far, the input device 1 in an embodiment of the present invention has been specifically described. However, the present invention is not limited to the embodiment described above. Various changes are possible in the present invention without departing from the intended scope of the present invention. For example, the present invention can also be practiced by making variations as described below. These variations are also included in the technical range of the present invention.

(1) Although, in this embodiment, to form the load adjusting parts 24, the second load generating parts 22 have been disposed at four places so as to be equally spaced on a circumference of a circle about the center line 32*b*, more second load generating parts 22 may be disposed. To fulfill the functions of the load adjusting parts 24 as an addition to the first load generating part 21, the second load generating part 22 only has to be provided at least one place at which the first load generating part 21 is not disposed. However, it is preferable to place a plurality of second load generating parts 22 in such a way that they are well balanced without falling over.

(2) Although, in the initial state in this embodiment, the pressing part 10*a* has been in contact with the pressed part 20*a* and each pressing part 10*b* has left a small clearance between it and its relevant pressed part 20*b*, the pressing parts 10*b* may be in contact with their relative pressed parts 20*b* in the initial state. Alternatively, in the initial state, each load adjusting part 24 may be elastically deformed to generate a load.

(3) Although, in this embodiment, the movable contact 32 is shaped so as to have an invertible dome shape at the top 32*a*, the movable contact 32 is not limited to a contact that performs an inversion operation. For example, the structure of the movable contact 32 may be changed so as to be shaped like a leaf spring such as a cantilever spring. Alternatively, a movable contact may be provided on the rubber member 20 and a fixed contact may be provided on the supporting circuit board 50.

What is claimed is:

1. An input device comprising:

a switch unit that has a fixed contact and a movable contact, the movable contact movable away from and toward the fixed contact;

an elastically deformable rubber member, the rubber member pressing the movable contact; and a slide member placed so as to be movable so that the slide member is capable of pressing the rubber member; wherein:

the rubber member has a first load generating part, which presses the movable contact, and a plurality of load adjusting parts disposed so as to enclose the first load generating part, and the slide member has a first pressing part, which presses the first load generating part, and a plurality of second pressing parts, which press the plurality of load adjusting parts, wherein the load adjusting parts comprise a thin stereoscopic shape having a side wall in a cylindrical shape; and part of the side wall is open toward the first load generating part.

2. The input device according to claim 1, wherein:

each of the plurality of adjusting parts is a second load generating part, which is adjustable so as to generate a different load from the first load generating part;

the first load generating part is disposed so as to be rotationally symmetric with respect to a center line of the switch unit; and a plurality of second load generating parts are disposed so as to be equally spaced on a circumference of a circle about the center line.

3. The input device according to claim 1, wherein:

the rubber member has a first pressed part and a plurality of second pressed parts, the first pressed part and the plurality of second pressed parts being pressed by the slide member; and a timing at which the first pressed part, which is disposed at the first load generating part, abuts the first pressing part is set so as to differ from timings at which the plurality of second pressed parts, which are disposed at the load adjusting parts, abut the plurality of second pressing parts.

4. The input device according to claim 1, wherein, at the load adjusting parts, the rubber member comprises a thin stereoscopic shape, and a rear surface of the second pressed part faces a hollow at a portion that abuts the second pressing part.

5. The input device according to claim 1, wherein:

the rubber member comprises a material into which less water infiltrates; and the rubber member comprises a sheet-like shape so as to cover the switch unit.

* * * * *